US006817115B2

(12) United States Patent
Polifroni

(10) Patent No.: US 6,817,115 B2
(45) Date of Patent: Nov. 16, 2004

(54) TEXTURED ARCH SUPPORT DEVICE AND METHOD OF MANUFACTURE

(76) Inventor: Joseph Paul Polifroni, c/o 261 N. Highway 101, Solona Beach, CA (US) 92075

( * ) Notice: Subject to any disclaimer, the term of this patent is extended or adjusted under 35 U.S.C. 154(b) by 7 days.

(21) Appl. No.: 09/965,885

(22) Filed: Sep. 28, 2001

(65) Prior Publication Data

US 2003/0061739 A1 Apr. 3, 2003

(51) Int. Cl.[7] ..... A43B 7/22; A43B 7/14; A61F 5/14

(52) U.S. Cl. ..... 36/91; 36/145; 36/154; 36/178; 36/59 C

(58) Field of Search ..... 36/91, 145, 154, 36/161, 166, 167, 178, 180, 43, 59 C, 141, 44, 71

(56) References Cited

U.S. PATENT DOCUMENTS

| | | | | | |
|---|---|---|---|---|---|
| 466,592 | A | * | 1/1892 | Bailey | 36/43 |
| 1,746,002 | A | * | 2/1930 | Lobel | 36/154 |
| 1,867,431 | A | * | 7/1932 | Wood | 36/43 |
| 2,055,072 | A | * | 9/1936 | Everston | 36/71 |
| 2,771,691 | A | | 11/1956 | Luchs | |
| 2,793,136 | A | * | 5/1957 | Root | 36/71 |
| 2,959,875 | A | * | 11/1960 | Frese, Jr. | 36/71 |
| 2,978,818 | A | | 4/1961 | Baumann | |
| 3,543,765 | A | | 12/1970 | Alzner | |
| 3,985,853 | A | | 10/1976 | Weisberg | |
| 4,187,620 | A | | 2/1980 | Selner | |
| 4,188,736 | A | * | 2/1980 | Keller | 36/43 |
| 4,541,184 | A | | 9/1985 | Leighton | |
| 4,571,857 | A | | 2/1986 | Castellanos | |
| 4,619,056 | A | | 10/1986 | Lin et al. | |
| 4,694,590 | A | | 9/1987 | Greenawalt | |
| 4,702,255 | A | | 10/1987 | Schenkl | |
| 4,718,179 | A | | 1/1988 | Brown | |
| 4,897,937 | A | * | 2/1990 | Misevich et al. | 36/43 |
| 4,972,612 | A | | 11/1990 | Prukop et al. | |
| 5,282,326 | A | | 2/1994 | Schroer, Jr. et al. | |
| 5,359,791 | A | | 11/1994 | Prahl et al. | |
| 5,394,626 | A | | 3/1995 | Brown | |
| 5,463,824 | A | | 11/1995 | Barna | |
| 5,611,153 | A | | 3/1997 | Fisher et al. | |
| 5,636,456 | A | | 6/1997 | Allen | |
| 5,714,229 | A | * | 2/1998 | Ogden | 36/44 |
| 5,940,994 | A | | 8/1999 | Allen | |
| 6,042,759 | A | | 3/2000 | Marshall | |
| 6,138,383 | A | * | 10/2000 | Steinke et al. | 36/44 |
| 6,247,250 | B1 | | 6/2001 | Hauser | |
| D446,913 | S | | 8/2001 | Holden | |

* cited by examiner

*Primary Examiner*—Anthony Stashick
(74) *Attorney, Agent, or Firm*—Stephen C. Beuerle; Procopio Cory Hargreaves & Savitch LLP

(57) ABSTRACT

An arch support device has a periphery shaped to conform to at least part of the periphery of the sole of a wearer's footwear, an upper surface, a lower surface, a heel region, an arch region, and a toe region, each region being designed to lie under the corresponding regions of a wearer's foot when in use. At least part of at least one of the surfaces of the device has a slip-resistant surface texture for resisting slipping, with the textured surface formed during injection molding of the device in a mold which is roughened over at least part of its surface. Slip-resistant surface portions on both the upper and lower surface will resist slipping of a wearer's foot relative to the device and slipping of the device relative to the footwear.

23 Claims, 2 Drawing Sheets

TEXTURED ARCH SUPPORT DEVICE AND METHOD OF MANUFACTURE

BACKGROUND OF THE INVENTION

The present invention relates to arch or foot supports for insertion in footwear in order to provide better comfort and more correct positioning and support of the wearer's feet, and to a method of manufacturing such supports.

Many individuals who are on their feet or walking for significant periods of time encounter problems usually associated with uncomfortable footwear. Such problems often arise as a result of insufficient arch support in conventional shoes and other footwear. Thus, various types of shoe inserts have been devised in order to alleviate such problems. Some inserts consist only of a foam or padded cushion member or insole, and provide no arch support. It is also known to provide more sophisticated arch supports formed of molded rigid or semirigid materials, such as plastic, and these are sometimes custom-fitted to the individual, which makes them relatively expensive. In some cases, a leather upper layer is applied to the top surface of the arch support.

The molded plastic material typically used for arch supports has a relatively smooth surface and sometimes tends to slip relative to the shoe, or the user's foot may slip on the smooth upper surface of the device. This can cause misalignment and discomfort. In some prior art molded inserts, it is known to provide raised ribs or other uniform raised patterns on the lower surface of the arch support. However, this increases manufacturing expense and may potentially damage the sole of the shoe. In U.S. Pat. No. 4.694,590 of Greenawalt, an arch support for a heeled shoe has a patch of hook and loop type fastener material at the heel, which engages a mating pad of hook and loop fastener material secured in the heel region of the shoe. This requires modification of the shoe itself and results in a shoe which cannot be worn without the insert.

SUMMARY OF THE INVENTION

It is an object of the present invention to provide a new and improved arch support device.

According to one aspect of the present invention, an arch support device is provided, which comprises a substantially rigid member having a periphery shaped to conform to at least part of the periphery of a wearer's shoe, the member having an upper surface, a lower surface, and being contoured to follow the contours of the sole of a wearer's foot, the member having a heel region at one end, an arch region, and a toe region at an opposite end, each region being designed to lie under the corresponding regions of a wearer's foot when in use, at least the heel region of the lower surface having a non-smooth surface portion for resisting slipping of the element relative to the sole of a shoe in which it is inserted, the non-slip surface portion having a surface roughness of not more than 0.02 inches.

The non-slip surface portion is a molded surface texture in an exemplary embodiment of the invention, produced by a sand-blast texture finish of a corresponding portion of a mold in which the device is formed by injection molding. The mold finish may have a relatively even surface roughness in the range of around 0.001 to 0.01 inches peak to valley, and, in an exemplary embodiment, the mold surface roughness was in the range from 0.001 to 0.002 inches. The measurement is of the average peak to valley depth or height of the random depressions in the mold surface formed by the sand-blasting. This finish produces a dull or frosted surface appearance in the molded plastic product, rather than easily visible projections, but the product will still have substantially improved non-slip frictional properties, without tending to damage any surface against which it is placed. It will also be less expensive than a molding technique to produce a pronounced regular pattern of projections, such as ribs or the like. Vapor-honing may be used for small area sand blasting of predetermined portions of the mold surface.

In an exemplary embodiment of the invention, the lower surface of the arch support element also has a similarly textured non-slip surface portion in the toe region adjacent the front end. Non-slip surface portions may also be provided on the upper surface, to resist slipping between the arch support and the user's foot. The non-slip portions may be provided only in the heel and toe regions, or may extend over the entire surface of the arch support element, and may be provided on only the lower surface, or on both the lower and upper surfaces.

The non-slip surface portion or portions comprises a surface texturing or roughening formed by sand-blasting or the like, of the type generally known as a "frosted" surface texture. The frosted texture may also be provided by sand-blasting the mold surfaces corresponding to the upper and lower surface of the arch support device, either over part or all of each surface, as discussed above, with the mold surfaces having a sand-blast surface texture over some or all of their area. This produces a frosted appearance and texture to the arch support surfaces, and has very good non-slip properties.

In another embodiment of the invention, an insert of rubber or other slip-resistant material may be provided at the desired locations on the lower and/or upper surface. The rubber insert may be secured by adhesive in a suitable indent in the surface. Alternatively, a rubber layer of appropriate shape and size may be applied on top of the surface of the arch support element at the desired location or locations.

By providing textured non-slip surface portions at regions of the lower surface of the arch support device which contact the sole of the shoe, and regions of the upper surface which contact the sole of the wearer's foot, the tendency of the arch support to slip relative to the shoe and of the wearer's foot to slip relative to the arch support can be reduced or eliminated. This provides better positioning accuracy and comfort to the wearer.

BRIEF DESCRIPTION OF THE DRAWINGS

The present invention will be better understood from the following detailed description of some exemplary embodiments of the invention, taken in conjunction with the accompanying drawings in which like reference numerals refer to like parts and in which.

DETAILED DESCRIPTION OF THE DRAWINGS

Figure 1:
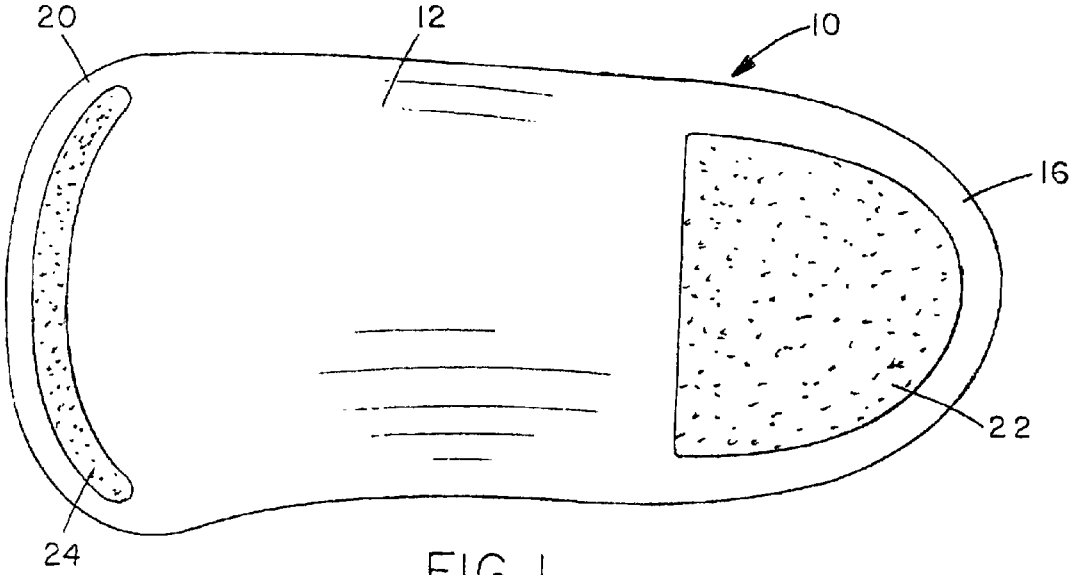
FIG. 1 is a plan view of the lower surface of an arch support device according to an exemplary embodiment of the invention.
Figure 2:
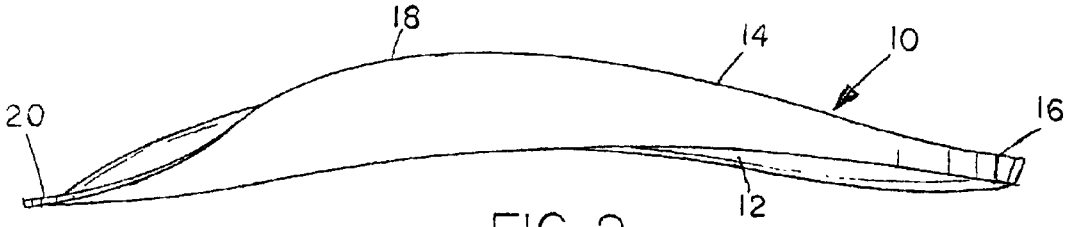
FIG. 2 is a side elevation view of the device of FIG. 1.
Figure 3:
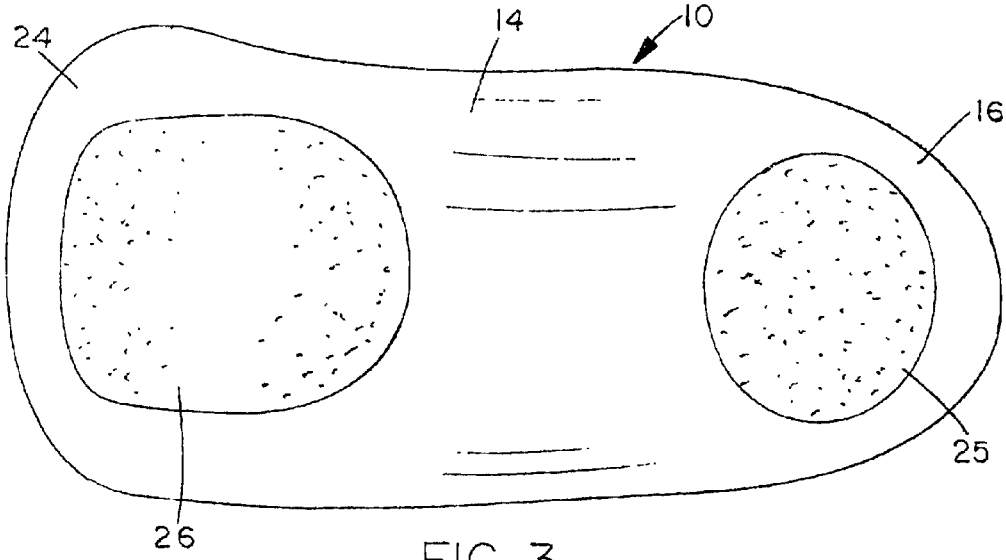
FIG. 3 is a plan view of the top surface of the device of FIGS. 1 and 2.

FIGS. 1 to 3 of the drawings illustrate an arch support device 10 according to an exemplary embodiment of the present invention. The device 10 is of molded, rigid or semi-rigid plastic material which is shaped to follow the contours of the sole of a user's foot, and to be placed in footwear with the lower surface 12 facing downwardly and the upper surface 14 facing upwardly. The arch support device may be full length, corresponding substantially to the length of the sole of the footwear in which it is placed, or ¾ length, extending from the heel up to a location adjacent the toe region of the footwear, as is known in the field.

The device 10 is shaped to provide a heel region 16, an arch region 18 corresponding to the arch of the foot, and a toe region or metatarsal rise 20, so as to provide support and comfort to the wearer's foot when using the device in footwear. As illustrated in FIG. 1, the lower surface 12 has a first textured area 22 in the heel region 16 and a second textured area 24 extending across the toe region 20 in an arch. Each of the textured areas 22,24 has a lightly roughened or frosted surface texture.

The upper surface 14 of the device 10 also has two textured areas 25,26, the first area 25 lying in the heel region so that it will be positioned under a wearer's heel, and the second area 26 extending from the toe region towards the arch region 18. Again, the textured areas 25,26 have a lightly roughened or frosted surface texture, as compared to the remainder of the surface which is relatively smooth.

The roughened surface texture may be achieved by sand-blasting of the finished product. Alternatively, since the device 10 is manufactured by injection molding, the textured areas may be formed by sand-blasting corresponding regions of the mold. In an exemplary embodiment, the textured areas were formed by injection molding in a mold of corresponding shape in which areas of the mold surfaces corresponding to areas 22,24,25 and 26 were roughened by vapor-hone sand blasting to produce a relatively uniform surface roughness or texture in the range from 0.001 inches to 0.010 inches, peak to valley, and suitably in the range from 0.001 inches to 0.002 inches. This produces a corresponding surface roughness on the same areas of the molded product, with the actual roughness being dependent on the hardness of the plastic material used to make the device. Some suitable plastic materials are elastomeric resins with an average durometer in the range of 50 to 100, and EVA plastic materials.

Figure 4:
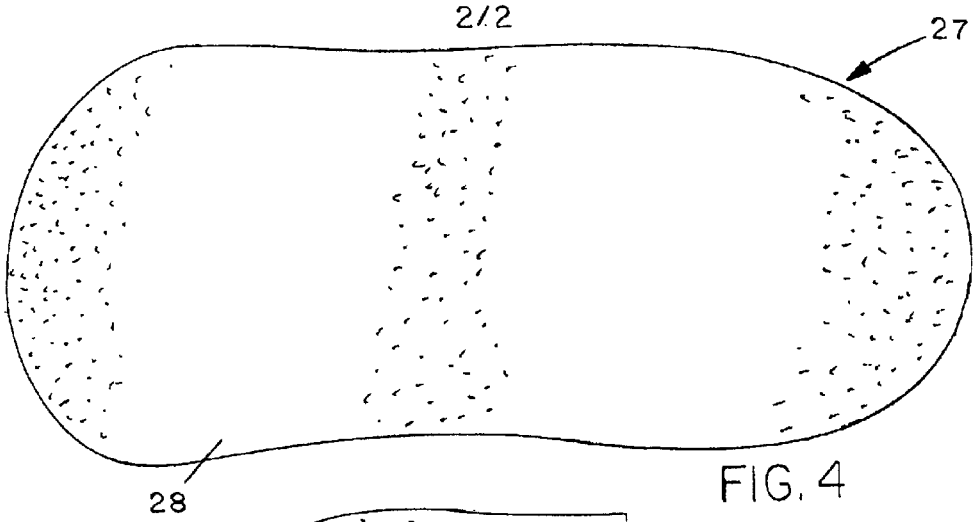
FIG. 4 is a plan view of the lower surface of a modified arch support device.
Figure 5:
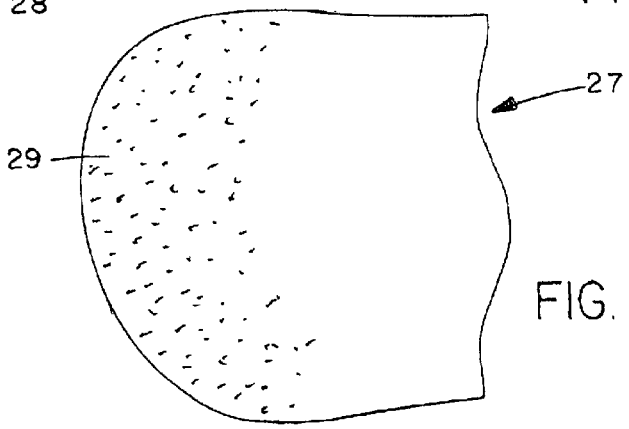
FIG. 5 is a partial plan view of the heel end of the upper surface of the modified arch support device of FIG. 4.

FIGS. 4 and 5 illustrate an arch support device 27 according to an alternative embodiment in which the lower surface 28 and upper surface 29 are frosted or roughened over their entire area. This may achieved by sand-blasting the entire surface of the mold which corresponds to the upper and lower surface of the finished product, producing a sand-blast surface finish with a roughness in the range of 0.001 to 0.02 inches. In an exemplary embodiment, the mold sand-blast surface finish had a very fine roughness in the range from 0.001 to 0.002 inches. It will be understood that only the lower surface may be roughened or frosted in some embodiments.

The arch support device as illustrated in FIGS. 1 to 3 or 4 and 5 will have superior non-slip properties, without having to have any relatively large ribs or projections. The textured areas or area on the lower surface will contact the sole of footwear in which the device 10 is placed, and will tend to resist slipping of the device relative to the footwear. The textured area or areas on the upper surface will contact the sole of the wearer's foot, and therefore tend to resist slipping of the foot relative to the arch support device. This avoids the problem of the arch support device shifting relative to the foot or footwear as the wearer moves around, which can cause discomfort. At the same time, the device is relatively inexpensive to manufacture and does not have to have any molded in, relatively large projections such as ribs or the like. Instead, a very fine, random surface roughness is produced by the vacuum-hone sand-blasted mold surface or surfaces, which may be more or less invisible to the eye in some cases.

The textured area or areas may be provided on only one or both surfaces of the arch support device, and may extend over only part of the respective surface, as in FIGS. 1 and 3, or over the entire surface, as in FIGS. 4 and 5. Where textured areas are provided over only part of the surface, they are located at least in the heel and toe regions, and extend over more than one quarter of the total surface area of the respective surface.

The arch support devices of the previous embodiments may be made in any conventional arch support shape dependent on the type of foot to be supported, and in full length or three quarter lengths, as is known for conventional arch supports. They may also be manufactured out of any of the conventional plastic materials used for such supports, ranging in hardness from substantially rigid to semi-rigid and flexible. Although the roughened surface areas may be produced by sand blasting of the part itself, or of the mold surfaces in which the part is formed by injection molding, other surface roughening techniques may alternatively be used. These include electro-static machining, which produces a surface roughness of the order of 0.003 to 0.02 inches, or chemical etching, which produces surface roughness of the order of 0.005 to 0.050 inches. It will be understood that in each case, the mold surface will be roughened rather than the part itself, since this will produce more uniform results. Additionally, the actual surface roughness measurement on the surfaces of the arch support device may not be in exactly the same range as on the mold surface, due to the different hardness characteristics of the mold material and the plastic materials used in manufacturing the device. However, in each case, a relatively uniform and light surface roughness will be produced on the surface of the arch support device, having excellent slip-resistance without interfering with comfort of using the device. Sand-blasting will be less expensive than the other surface roughening techniques.

Figure 6:
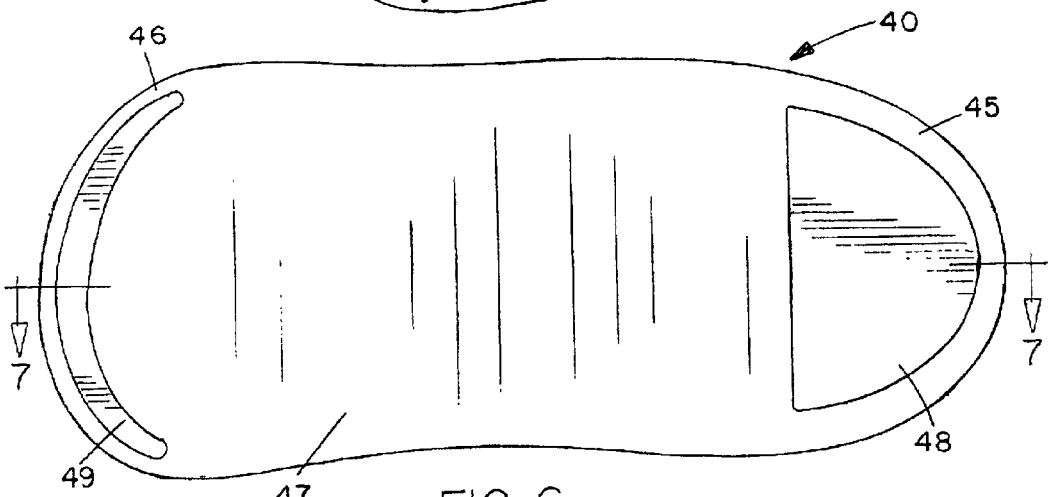
FIG. 6 is a plan view of the lower surface of another modified arch support device with slip-resistant inserts.
Figure 7:
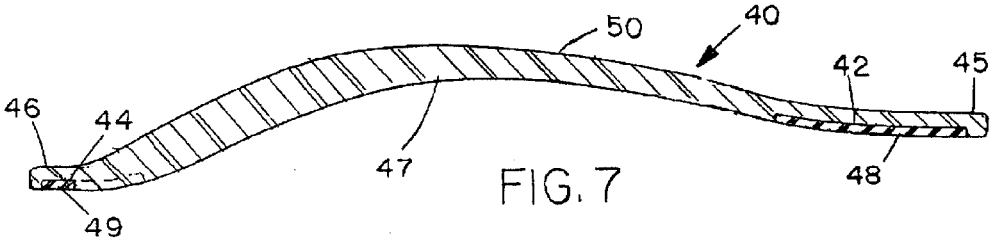
FIG. 7 is a cross-section along the lines 7—7 of FIG. 6.

FIGS. 6 and 7 illustrate an arch support device 40 according to another embodiment of the invention. In this case, instead of surface texturing of the actual plastic material forming the arch support device, cut-outs or indents 42,44 are provided in the heel region 45 and toe region 46 of the lower surface 47. Slip resistant inserts 48 and 49 are secured in the respective indents 42,44 by adhesive. The inserts 48,49 may be of any suitable slip resistant material, such as rubber or the like. Rubber inserts may also be provided on the upper surface 50 of the device in a similar manner, for example in areas corresponding to the frosted areas 25 and 26 of FIG. 3.

The rubber inserts 48 and 49 will engage the sole of the footwear in which the device is placed, in the heel and toe regions, and will tend to resist slipping of the device 40 relative to the footwear. Instead of providing inserts 48,49 in cut-outs in the arch support device, a thin layer of rubber material or the like may be secured over the lower surface of the device with adhesive, either in regions corresponding to the indents 45,46, or extending over the entire lower surface. Similarly, a thin layer of rubber material or the like may be secured over all or part of the upper surface of the arch support device.

By providing textured surface regions over some or all of the lower and/or upper surfaces of a molded plastic arch support device, operation and comfort of the device can be improved considerably. The frosted or otherwise roughened or textured surface areas on the lower surface will contact the sole of the shoe or other footwear, and will resist slipping of the arch support relative to the footwear, which is an otherwise common problem. Similarly, the textured surface areas on the upper surface will contact the sole of the wearer's foot and resist slipping of the foot relative to the arch support and resultant potential misalignment of the foot with the arch support, which would be uncomfortable. This is particularly advantageous since the user will normally be wearing socks or hose, which will have a tendency to slip against a relatively smooth plastic surface. Similar advantages are obtained by using rubber inserts or cover layers on the arch support device.

Although some exemplary embodiments of the invention have been described above by way of example only, it will be understood by those skilled in the field that modifications may be made to the disclosed embodiments without departing from the scope of the invention, which is defined by the appended claims.

I claim:

1. An arch support device, comprising:

a support member having a periphery shaped to conform to at least part of the periphery of the sole of a wearers footwear, the member having an upper surface, a lower surface, and being contoured to follow the contours of the sole of a wearers foot, the member having a heel region at one end, an arch region, and a toe region at an opposite end, each region being designed to lie under the corresponding regions of a wearers foot when in use;

at least the heel region of the lower surface having a slip-resistant surface portion for resisting slipping of the element relative to the sole of a shoe in which it is inserted, the slip-resistant surface portion having a surface roughness of not more than 0.02 inches peak to valley and comprises a frosted surface texture formed in the arch support member.

2. The device as claimed in claim 1, including a second slip-resistant surface portion in the toe region of the lower surface of the arch support member.

3. The device as claimed in claim 1, wherein the upper surface of the arch support member has a slip-resistant surface portion extending over at least part of the upper surface.

4. The device as claimed in claim 3, wherein slip-resistant portions are provided in predetermined areas of the heel region and toe region of the upper surface.

5. The device as claimed in claim 1, wherein the slip-resistant portion extends over the entire lower surface of the arch support member.

6. The device as claimed in claim 5, wherein the entire upper surface of the arch support member has a roughened surface texture identical to that of the lower surface.

7. The device as claimed in claim 1, wherein the frosted surface texture extends over the entire lower surface of the arch support member.

8. The device as claimed in claim 1, wherein the upper surface of the arch support member has a frosted surface texture extending over at least part of the upper surface.

9. The device as claimed in claim 8, wherein the frosted surface texture extends aver the entire upper surface of the arch support member.

10. The device as claimed in claim 1, wherein the slip-resistant portion comprises a layer of a slip-resistant material secured to the lower surface of the arch support member.

11. The device as claimed in claim 10, wherein the slip-resistant material is rubber.

12. The device as claimed in claim 10, wherein the lower surface of the member has an indent in the heel region, and the slip-resistant layer comprises an insert secured in the indent with an outer surface substantially flush with the lower surface of the arch support member.

13. The device as claimed in claim 12, wherein the lower surface has a second indent extending across the toe region, and a second insert of slip-resistant material is secured in the second indent.

14. An arch support device, comprising:

a member having a periphery shaped to conform to at least part of the periphery of the sole of a wearers footwear, the member having an upper surface, a lower surface, and being contoured to follow the contours of the sole of a wearers foot, the member having a heel region at one end, an arch region, and a toe region at an opposite end, each region being designed to lie under the corresponding regions of a wearers foot when in use; and a textured, slip-resistant surface portion extending over at least part of at least one of the surfaces of the arch support member, the slip-resistant surface portion covering an area equal to at least one quarter of the total surface area of the lower surface wherein the slip-resistant portion comprises a frosted surface texture.

15. The device as claimed in claim 14, wherein the slip-resistant surface portion is provided in the lower surface.

16. The device as claimed in claim 14, wherein the slip-resistant surface portion is provided in the upper surface.

17. The device as claimed in claim 14, wherein textured, slip-resistant surface portions are provided on both the upper surface and the lower surface of the arch support member.

18. The device as claimed in claim 14, wherein the entire lower surface of the arch support member has a frosted surface texture.

19. The device as claimed in claim 18, wherein the entire upper surface of the arch support member has a frosted surface texture.

20. The device as claimed in claim 14, wherein the slip-resistant portion comprises an injection molded surface finish produced by a sand-blasted mold surface.

21. The device as claimed in claim 14, wherein the slip-resistant portion has a surface roughness in the range from 0.0005 to 0.02 inches.

22. The device as claimed in claim 21, wherein the slip-resistant portion has a surface roughness in the range from 0.001 to 0.002 inches.

23. An arch support device, comprising:

a member having a periphery shaped to conform to at least part of the periphery of the sole of a wearer's footwear, the member having an upper surface, a lower surface, and being contoured to follow the contours of the sole of a wearers foot, the member having a heel region at one end, an arch region, and a toe region at an opposite end, each region being designed to lie under the corresponding regions of a wearers foot when in use; and a textured, slip-resistant surface portion extending over at least part of at least one of the surfaces of the arch support member, the slip-resistant surface portion comprising a random, frosted, injection molded surface texture produced by a sand-blasted mold surface.

* * * * *